US009435350B2

(12) United States Patent
Shirahama et al.

(10) Patent No.: US 9,435,350 B2
(45) Date of Patent: Sep. 6, 2016

(54) AIR BLOWING DEVICE

(75) Inventors: Seiji Shirahama, Aichi (JP); Munetada Satou, Aichi (JP); Masayuki Takada, Aichi (JP); Kazuhiro Muromachi, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 793 days.

(21) Appl. No.: 13/256,527

(22) PCT Filed: Mar. 4, 2010

(86) PCT No.: PCT/JP2010/001495

§ 371 (c)(1),
(2), (4) Date: Sep. 14, 2011

(87) PCT Pub. No.: WO2010/116604

PCT Pub. Date: Oct. 14, 2010

(65) Prior Publication Data

US 2012/0014789 A1 Jan. 19, 2012

(30) Foreign Application Priority Data

Apr. 7, 2009 (JP) ..... 2009-092636

(51) Int. Cl.
*F04D 29/42* (2006.01)
*F04D 27/00* (2006.01)

(52) U.S. Cl.
CPC ..... *F04D 29/4226* (2013.01); *F04D 27/009* (2013.01); *F04D 29/422* (2013.01)

(58) Field of Classification Search
CPC ..... F04D 29/4213; F04D 29/422; F04D 29/4226; F04D 29/4233
USPC ..... 415/204, 206, 224
See application file for complete search history.

(56) References Cited

U.S. PATENT DOCUMENTS 5,471,537 A 11/1995 Castwall
5,813,831 A 9/1998 Matsunaga et al.
6,056,772 A * 5/2000 Bonutti ..... 606/232
6,468,034 B1 * 10/2002 Garrison ..... F04D 29/4226 415/200

(Continued)

FOREIGN PATENT DOCUMENTS

JP 55-140799 10/1980
JP 61-60034 4/1986

(Continued)

OTHER PUBLICATIONS

International Search Report for PCT/JP2010/001495, Apr. 20, 2010.

(Continued)

*Primary Examiner* — Craig Kim
*Assistant Examiner* — Michael Sehn
(74) *Attorney, Agent, or Firm* — RatnerPrestia

(57) ABSTRACT

An air blowing device includes a housing with a suction port and a blow-off port, and a fan placed in the housing. The fan includes a fan case with a tongue section, an impeller, and a motor. The fan case includes an inlet and an outlet, and is shaped such that a space between the impeller and an inner wall of the fan case increases along a rotary direction of the impeller up to a cross section cut along a line between the tongue section and its opposite section. An opening area of the fan case at the tongue section is kept equal or decreases up to the outlet.

14 Claims, 7 Drawing Sheets

(56) References Cited

U.S. PATENT DOCUMENTS

| | | | | |
|---|---|---|---|---|
| 6,979,169 | B2 * | 12/2005 | Penlesky et al. | 415/1 |
| 7,001,149 | B1 * | 2/2006 | Waggoner et al. | 415/204 |
| 7,473,074 | B2 * | 1/2009 | Herbst et al. | 415/213.1 |
| 2002/0098084 | A1 * | 7/2002 | Gatley, Jr. | F04D 29/162 415/206 |
| 2004/0165984 | A1 * | 8/2004 | Ochiai et al. | 415/206 |
| 2006/0034686 | A1 * | 2/2006 | Smiley et al. | 415/204 |
| 2011/0008159 | A1 * | 1/2011 | Masuda et al. | 415/203 |

FOREIGN PATENT DOCUMENTS

| | | | |
|---|---|---|---|
| JP | 1-157940 | U | 10/1989 |
| JP | 2-77532 | U | 6/1990 |
| JP | 04-041996 | A | 2/1992 |
| JP | 6-2699 | A | 1/1994 |
| JP | 6-207733 | A | 7/1994 |
| JP | 7-217598 | A | 8/1995 |
| JP | 7-269460 | A | 10/1995 |
| JP | 2512765 | Y2 | 7/1996 |
| JP | 9-209994 | A | 8/1997 |
| JP | 09209994 | A * | 8/1997 |
| JP | 9-242696 | A | 9/1997 |
| JP | 2000-227096 | A | 8/2000 |
| JP | 2005-291157 | A | 10/2005 |
| JP | 2009-191721 | A | 8/2009 |
| SE | 505 194 | C2 | 7/1997 |
| WO | WO 2009144778 | A1 * | 12/2009 |

OTHER PUBLICATIONS

CN Search Report for 201080014272.7, Jun. 27, 2013.

* cited by examiner

AIR BLOWING DEVICE

THIS APPLICATION IS A U.S. NATIONAL PHASE APPLICATION OF PCT INTERNATIONAL APPLICATION NO. PCT/JP2010/001495.

TECHNICAL FIELD

The present invention relates to an air blowing device.

BACKGROUND ART

A conventional air blowing device used for a ventilating fan mounted to a ceiling is described hereinafter. This blowing fan includes a housing having a suction port, a blow-off port, and a fan disposed within the housing. The fan includes a fan case, an impeller disposed in the fan case, and a motor for driving the impeller. The fan case includes a fan inlet communicating with the suction port and a fan outlet communicating with the blow-off port.

The fan case defined around the impeller, more specifically defined in an area up to a sectional face cut along a line between a tongue section and an opposite section to the tongue section, is shaped such that: a distance between the fan case and the impeller increases gradually along the rotary direction of the impeller. This structure is disclosed in, e.g. Patent Literature 1: Unexamined Japanese Patent Application Publication No. H04-41996.

However, the foregoing conventional device is obliged to accept a low efficiency of the motor. To be more specific, since the conventional blowing device is mounted to a ceiling as a ventilating fan, a rate of rotation of the impeller is kept low in order to lower an operating sound, i.e. a noise level. To compensate the lower rate of rotation, a size of the impeller is obliged to be larger so that a given performance can be achieved. The greater size of the impeller causes the greater load to the motor as a matter of course, thereby lowering the efficiency of the motor.

CITATION LIST

Patent Literature: Unexamined Japanese Patent Application Publication No. H04-41996

SUMMARY OF THE INVENTION

An air blowing device of the present invention comprises the following structural elements:

- a housing including a suction port for sucking air from a room and a blow-off port for blowing off the sucked air outside the room; and
- a fan disposed in the housing.

The fan includes a fan case with a tongue section, an impeller disposed in the fan case, and a motor for driving the impeller. The fan case includes a fan inlet communicating with the suction port and a fan outlet communicating with the blow-off port. The fan case is shaped such that: a space between the impeller and an inner wall of the fan case increases along a rotary direction of the impeller. An opening area of the fan case from the tongue section to the outlet is either kept equal, or decreases from an opening area at the tongue section. This structure allows the air blowing device to employ a smaller size impeller, so that load to the motor becomes smaller and thus the motor can work more efficiently.

DESCRIPTION OF EMBODIMENTS

An exemplary embodiment of the present invention is demonstrated hereinafter with reference to the accompanying drawings.

Exemplary Embodiment

Figure 1:
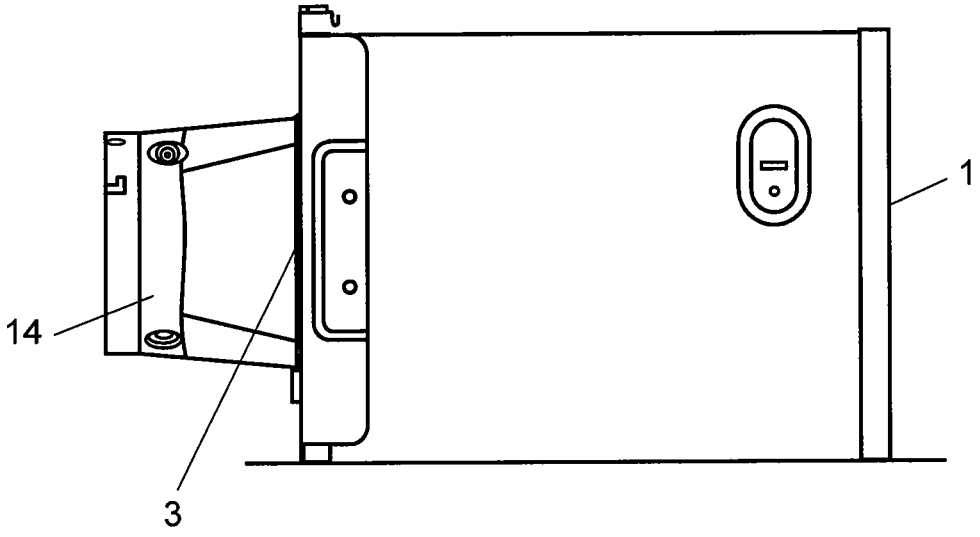
FIG. 1 is a front view of an air blowing device in accordance with an embodiment of the present invention.
Figure 2:
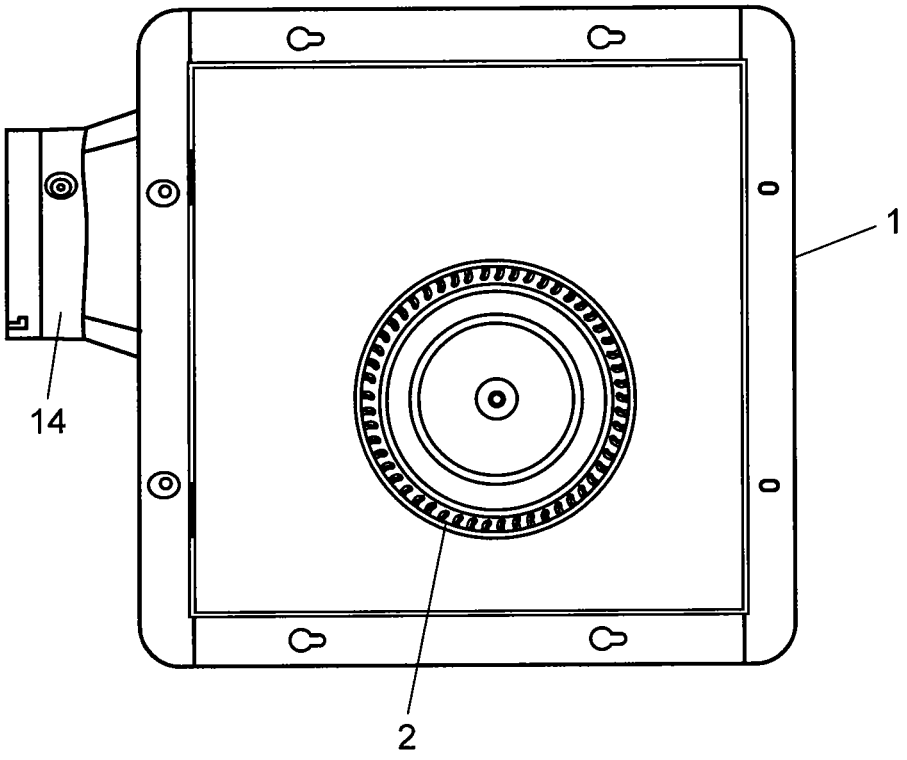
FIG. 2 is a bottom view of the air blowing device.

FIG. 1 is a front view of an air blowing device in accordance with this embodiment of the present invention, and FIG. 2 is a bottom view of the air blowing device. As shown in FIGS. 1 and 2, box-shaped housing 1 includes suction port 2 in the underside, and blow-off port 3 in the lateral face. Air in a room is sucked through suction port 2 and the air is blown off from blow-off port 3 outside the room.

Figure 3:
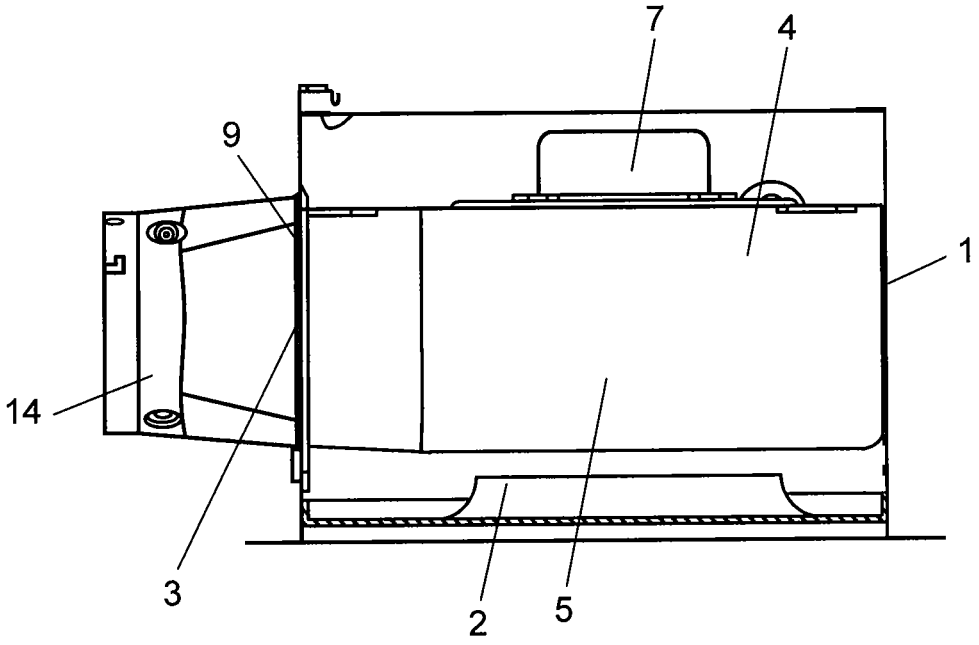
FIG. 3 is a front view of a housing of the air blowing device with a front face removed.
Figure 4:
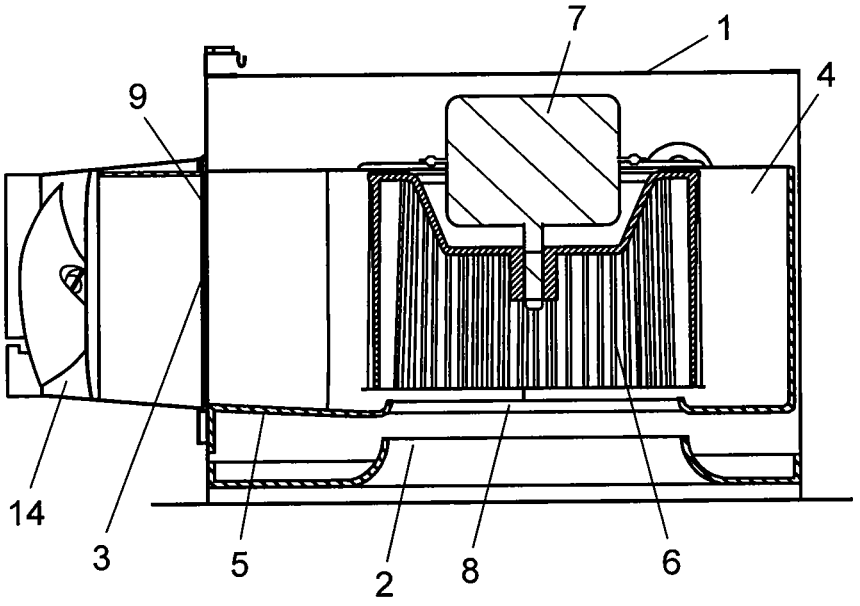
FIG. 4 is a front view of the housing of the air blowing device with the front face and a front face of a fan case removed.
Figure 5:
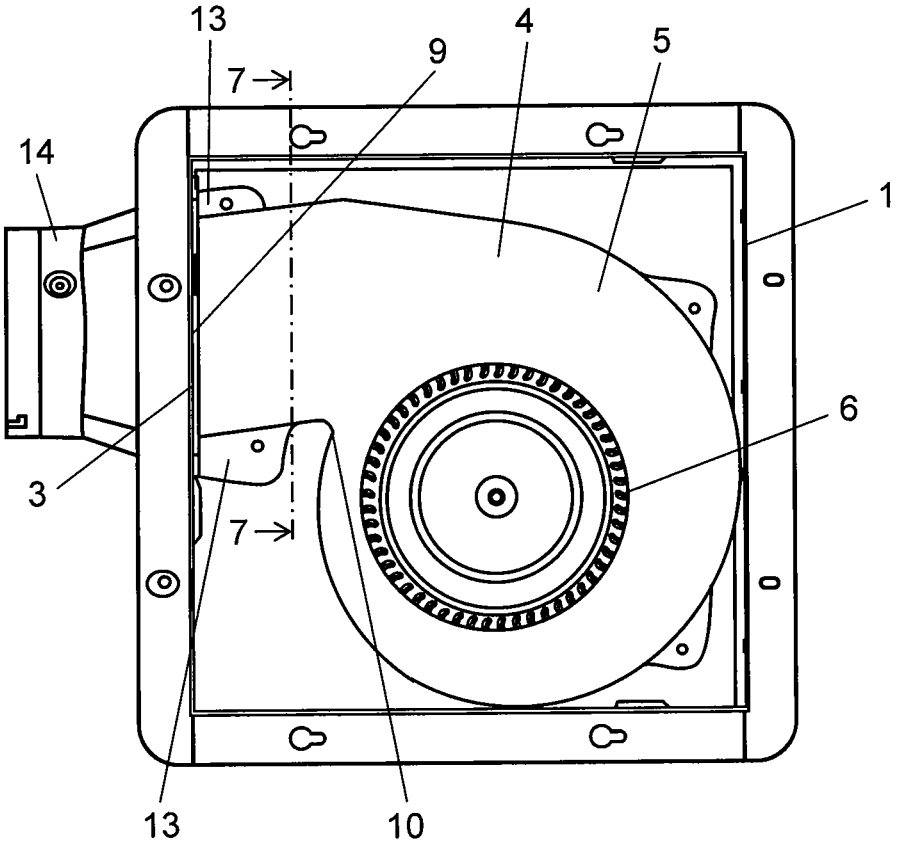
FIG. 5 is a bottom view of the housing of the air blowing device with a bottom face of the housing removed.

FIG. 3 is a front view of the housing of the air blowing device with a front face removed. FIG. 4 is a front view of the housing of the air blowing device with the front face and a front face of a fan case removed. FIG. 5 is a bottom view of the housing of the air blowing device with a bottom face of the housing removed. As shown in FIGS. 3-5, fan 4 is disposed in housing 1, and fan 4 is formed of fan case 5, impeller 6 disposed in fan case 5, and motor 7 that drives impeller 6.

Figure 6:
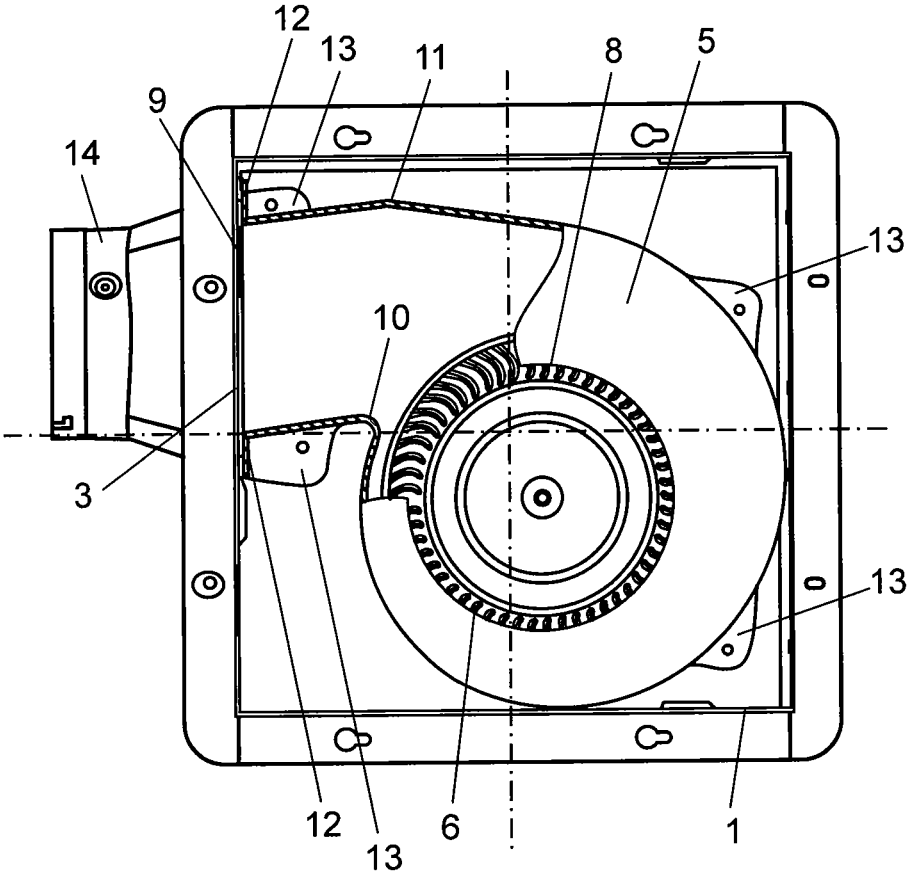
FIG. 6 is a bottom view of the housing of the air blowing device with a bottom face of the housing and a part of the fan case removed.
Figure 7:
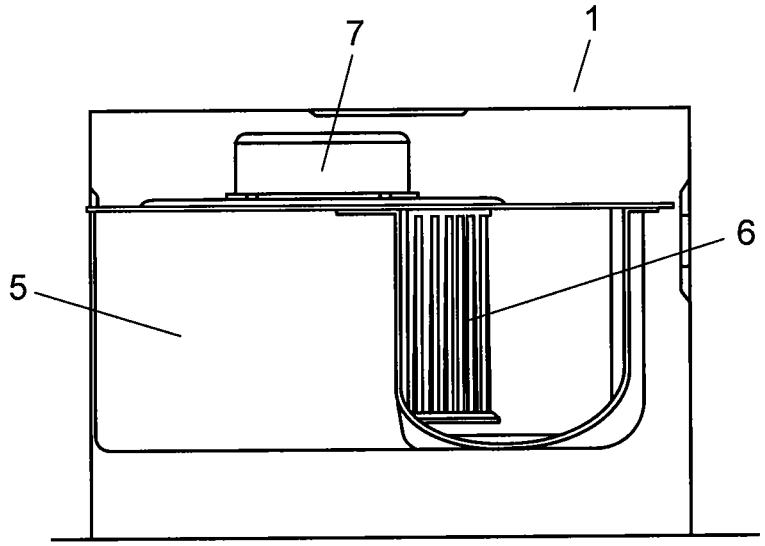
FIG. 7 is a sectional view cut along line 7-7 in FIG. 5.
Figure 8:
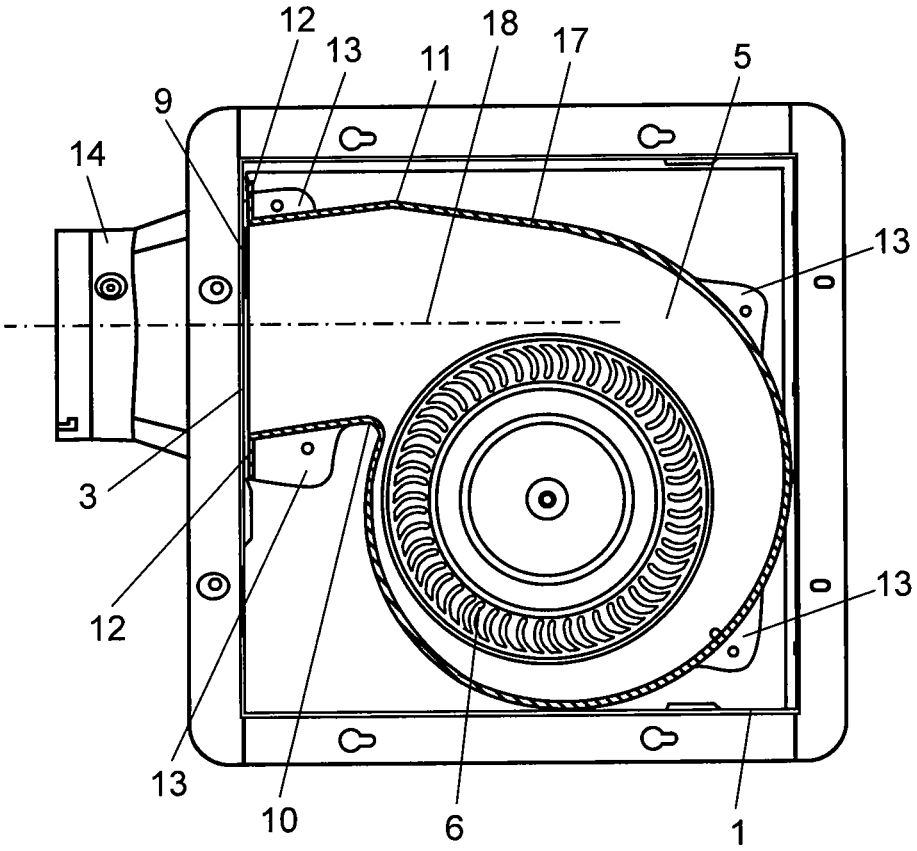
FIG. 8 is a bottom view of the housing of the air blowing device with a bottom face of the housing and the fan case removed.
Figure 9:
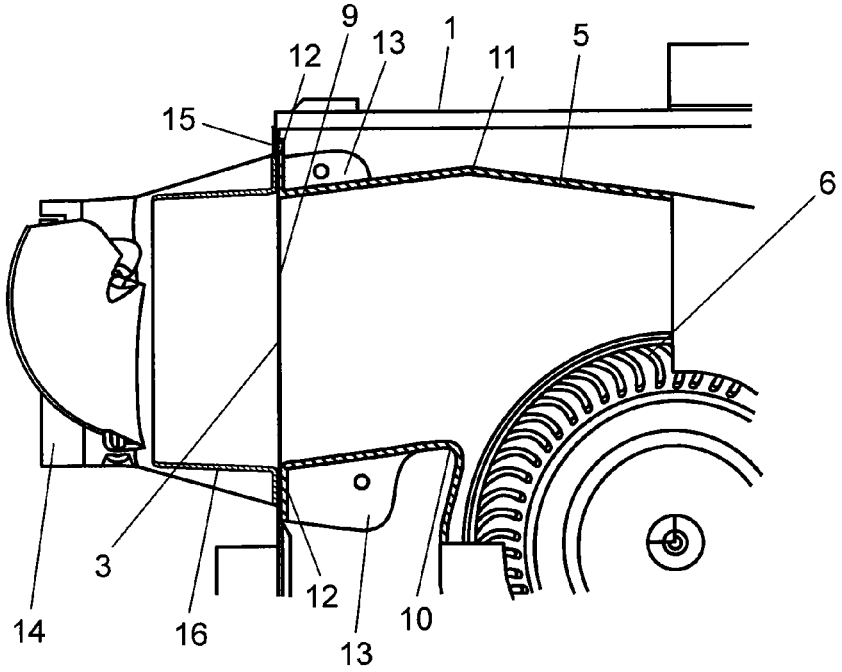
FIG. 9 is an enlarged bottom view of the housing of the air blowing device with a bottom face of the housing and a part of the fan case removed.

FIG. 6 is a bottom view of the housing of the air blowing device with a bottom face of the housing and a part of the fan case removed. FIG. 7 is a sectional view cut along line 7-7 in FIG. 5. FIG. 8 is a bottom view of the housing of the air blowing device with a bottom face of the housing and the fan case removed. FIG. 9 is an enlarged bottom view of the housing of the air blowing device with a bottom face of the housing and a part of the fan case removed.

Fan case 5 provided with tongue section 10 includes inlet 8 communicating with suction port 2 shown in FIGS. 3 and 4, and outlet 9 communicating with blow-off port 3 shown in FIGS. 5-9. Fan case 5 is shaped like this: a space between impeller 6 and an inner wall of fan case 5 gradually increases up to a cross section cut along a line between tongue section 10 and opposite section 11 to tongue section 10 in a rotary direction of impeller 6.

On top of that, as shown in FIGS. 6-9, an opening area of fan case 5 defined in an area from tongue section 10 to outlet 9 is kept equal to an opening area at tongue section 10 or gradually decreases, i.e. fan case 5 within this area runs straight. The opening area in this context is an area of a cross section of fan case 5 cut along vertically relative to a blowing direction of air generated by impeller 6. The lower limit of the opening area at outlet 9 side is 70% of the opening area of the cross section cut along the line between tongue section 10 and opposite section 11 to tongue section 10.

In this embodiment, the outer periphery of impeller 6 is unitarily formed with fan case 5 defined from outlet 9 to the cross section cut along the line between tongue section 10 and opposite section 11 to tongue section 10, so that fan case 5 can be mounted in housing 1 with ease.

As shown in FIGS. 6-9, flange 12 is disposed in housing 1 at an outer periphery of outlet 9 such that flange 12 can extend over the entire outer periphery of blow-off port 3, and outlet 9 thus connects to blow-off port 3 of housing 1. Fan case 5 defined from outlet 9 to tongue section 10 and opposite section 11 to tongue section 10 is provided with mounting section 13 used for mounting the fan case 5 to housing 1. This structure allows stabilizing a joint position between blow-off port 3 and outlet 9 provided with flange 12.

Other mounting sections 13 are provided to fan case 5 at places far from blow-off port 3. In this embodiment, four mounting sections 13 in total are employed for fixing the fan case 5 to housing 1.

As shown in FIG. 9, connecting duct 14 is externally connected to housing 1 at blow-off port 3, and duct 14 flares toward blow-off port 3 and finally becomes greater than port 3, namely, duct 14 at blow-off port 3 side has a greater opening area than that of blow-off port 3. Duct 14 is externally mounted to housing 1 at the outer periphery of blow-off port 3 with flange 15.

As shown in FIG. 9, inner duct 16 is provided inside duct 14, and an opening area of inner duct 16 at blow-off port 3 side is approx. equal to that of blow-off port 3, and the opening area of inner duct 16 gradually decreases from blow-off port 3 side toward the end of duct 14 (left side of FIG. 9).

In other words, the air duct of fan case 5 covering the area from the positions between tongue section 10 and opposite section 11 to tongue section 11 up to inner duct 16 gradually tapers or maintains approx. the same opening area, and also inner duct 16 gradually tapers toward the end of duct 14 (left side of FIG. 9) or maintains the same opening area. This structure prevents noises caused by disturbance in blowing.

In this embodiment, motor 7 is driven to rotate impeller 6 counterclockwise as shown in FIGS. 6-9, then air in a room around the ceiling is sucked into fan case 5 through suction port 2 and inlet 8. The air sucked into fan case 5 is transferred along the rotary direction of impeller 6 to the cross section cut along the line between tongue section 10 and opposite section 11 to tongue section 10. The air flows passing through the cross section cut along tongue section 10 and its opposite section 11, and then flows to duct 14 via outlet 9, blow-off port 3 of housing 1, and inner duct 16. The air is finally discharged to the outside of the room through an exhaust duct (not shown) connected to duct 14.

To be more specific, just after tongue section 10, an air duct is not sharply expanded as a conventional device did, so that no disturbance due to a negative pressure occurs in an air stream at the air duct just after tongue section 10 and thus no noise accompanying the disturbance can be heard.

The air duct in fan case 5 covering the area from the positions between tongue section 10 and its opposite section 11 to outlet 9 maintains approx. the same opening area or gradually tapers, and inner duct 16 also maintains approx. the same opening area or gradually tapers toward the end of duct 14 (left side in FIG. 9). This structure allows suppressing noises caused by disturbance in blowing.

The reason why the air duct discussed above can be formed is the employment of impeller 6 that is smaller than a conventional one. To be more specific, a plan area of impeller 6 is set within a range from ⅛ to ⅓ (inclusive) relative to a plan area of housing 1 shown in FIG. 8, and more preferably it falls within a range between ⅛ and ¼ (inclusive) of the plan area of housing 1. If the plan area of impeller 6 is smaller than ⅛ of the plan area of housing 1, the rate of rotation of impeller 6 should be increased extremely, otherwise sufficient air volume cannot be produced. The conventional blowing device has employed impeller 6 of which plan area is greater than ⅓ of the plan area of housing 1 in order to reduce the noise with a lower rate of rotation.

Figure 10:
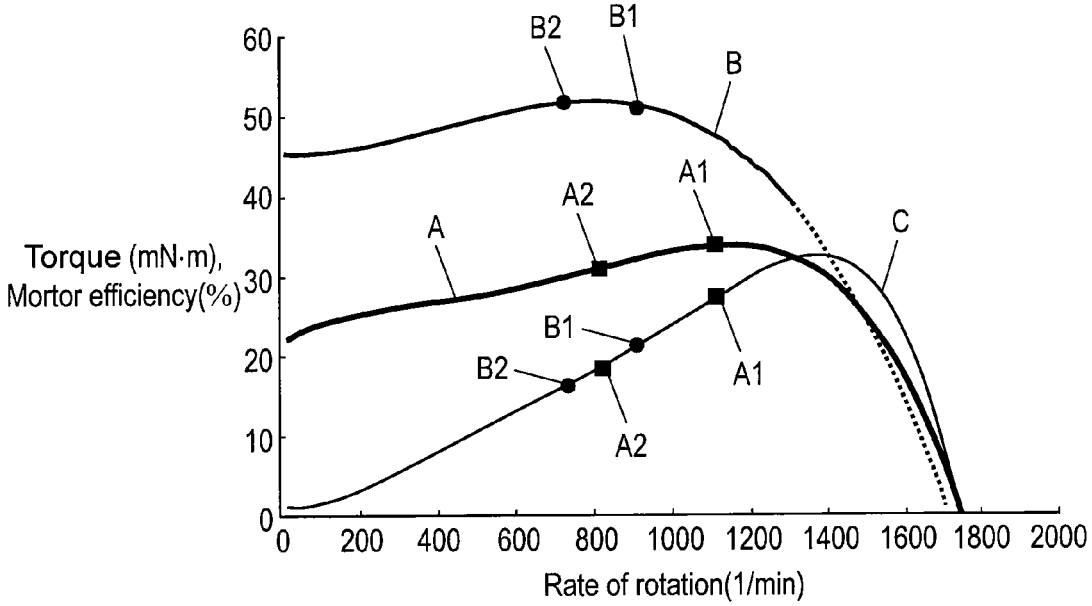
FIG. 10 shows characteristics of relation between torque, motor efficiency, and rate of rotation of the air blowing device.

FIG. 10 shows characteristics of a relation between the torque, the efficiency, and the rate of rotation of the air blowing device in accordance with this embodiment. Line A in FIG. 10 represents the torque in this embodiment, line B represents the torque of a conventional device, and line C represents an efficiency of motor 7.

As shown with line B, the conventional device needs greater torque (load) due to the employment of greater impeller 6; however, a smaller rate of rotation can be expected both in faster rotation B1 (approx. 900/min) and in slower rotation B2 (approx. 700/min). The low rate of rotation can thus reduce the operation noise. However, a sharp expansion of the air duct just after tongue section 10 causes disturbance in air stream due to a negative pressure at this expanded area, so that noise accompanying the disturbance is produced.

On the other hand, the blowing device in accordance with this embodiment needs smaller torque (load) as line A shows due to the employment of smaller impeller 6; however, the higher rate of rotation is needed both in a faster rotation A1 (approx. 1100/min) and in a slower rotation A2 (approx. 800/min), otherwise sufficient fan performance (blowing performance) cannot be obtained. The higher rate of rotation tends to cause greater operation noise.

To overcome the greater operation noise, the blowing device in accordance with this embodiment of the present invention makes full use of the employment of smaller impeller 6, i.e. fan case 5 tapers gradually or maintains its opening area approx. equal within the area from the cross section cut along the line between tongue section 10 and its opposite section 11 to outlet 9, and inner air duct 16 also gradually decreases or maintains its opening area approx. the same up to the end of duct 14 (left side in FIG. 9). This structure prevents the noise production caused by the disturbance in blowing within the air duct covering the area from the positions between tongue section 10 and its opposite section 11 and thereafter. A greater rate of rotation of impeller 6 as discussed above indeed increases the operation noise; however, this structure allows suppressing the noise at an extremely low level.

On top of that, as shown with line C in FIG. 10, motor 7 works more efficiently both at fast rotation A1 and slow rotation A2 of the blowing device of the present invention than at fast rotation B1 and slow rotation B2 of the conventional device. As a result, motor 7 consumes less electricity than the conventional case by 30% or more.

As shown in FIG. 6, the center of impeller 6 is positioned at the farthest region from outlet 9. This farthest region is one of four regions equally divided, both laterally and longitudinally across the plan area of housing 1. A distance from an arc-shaped tongue section 10 to outlet 9 is set not smaller than 5 times of a radius (e.g. 9 mm) of tongue section 10, and more preferably the distance is set not smaller than 6 times (e.g. 56 mm) thereof. This structure allows the air duct covering the area from the positions between tongue section 10 and its opposite section 11 and thereafter to be long enough. On top of that, a height of impeller 6 is set smaller than the diameter of duct 14. As shown in FIGS. 5 and 7, fan case 5 is curved to protrude toward the inlet 8 where impeller 6 exists. This structure allows preventing the air duct, defined in the area from the cross section cut along tongue section 10 and its opposite section 11 and thereafter, from encountering the noise caused by disturbance in blowing.

An incident acoustic wave into fan case 5 from connecting duct 14 reflects inside fan case 5, and enters duct 14 again, then resonance occurs to increase the noise. However, as shown in FIG. 8, linear section 17 before opposite section 11 continuously bends at the opposite section 11 as a vertex, and becomes closer to the centerline 18 of duct 14 as linear section 17 closes to the centerline 18 of duct 14. The continuous linear section 17 also closes to the centerline 18 of duct 14 as linear section 17 extends farther from outlet 9. This structure allows the incident acoustic wave into fan case 5 from duct 14 to reflect on linear section 17 along a direction different from duct 14, so that the noise can be further reduced.

INDUSTRIAL APPLICABILITY

The air blowing device of the present invention can be widely used as, e.g. a ventilation fan featuring low power consumption and calm operation.

REFERENCE MARKS IN THE DRAWINGS

1 housing
2 suction port of housing
3 blow-off port of housing
4 fan
5 fan case
6 impeller
7 motor
8 inlet of fan
9 outlet of fan
10 tongue section
11 opposite section to tongue section
12 flange
13 mounting section
14 connecting duct
15 flange
16 inner duct
17 linear section
18 centerline

The invention claimed is:

1. An air blowing device comprising:

a housing including a suction port for sucking air in a room and a blow-off port for discharging the air outside the room;

a fan disposed in the housing; and a connecting duct externally connecting to the blow-off port, wherein the fan includes a fan case having a tongue section, an impeller disposed in the fan case, and a motor for driving the impeller, the fan case includes an inlet communicating with the suction port and an outlet communicating with the blow-off port, the fan case is shaped such that a space between the impeller and an inner face of the fan case increases along a rotary direction of the impeller up to a cross section cut along a line between the tongue section and an opposite section to the tongue section, and an opening area of the fan case is maintained equal from the tongue section through the outlet, when viewed from a bottom face of the housing, the fan case has a linear section, the linear section being formed continuously and bending at the opposite section as a vertex, a portion of the linear section between the outlet and the vertex is parallel to a portion of the fan case between the outlet and the tongue section, and when the housing is connected to the connecting duct, the linear section becomes closer to a centerline of the duct as the linear section closes to the outlet of the fan case, the linear section also becomes closer to the centerline as the linear section extends farther from the outlet of the fan case, and a blow-off port side of the connecting duct has a greater opening area than an opening of the blow-off port.

2. The air blowing device of claim 1 further comprising a flange disposed to an outer periphery of the outlet, the flange extending over an outer periphery of the blow-off port at an interior side of the housing.

3. The air blowing device of claim 1, wherein the blow-off port is connected with the connecting duct for connection to an exhaust duct for discharging the air outside the room.

4. The air blowing device of claim 3, wherein a height of the impeller is smaller than a diameter of the connecting duct.

5. The air blowing device of claim 1, wherein the connecting duct includes an inner duct, and an opening area of the inner duct at the blow-off port side is equal to the opening area of the blow-off port of the housing.

6. The air blowing device of claim 1, wherein the fan case is formed unitarily, covering an area from positions between the tongue section and the opposite section thereto to the outlet including an outer periphery of the impeller.

7. The air blowing device of claim 6, wherein the fan case covering the area from the positions between the tongue section and the opposite section thereto to the outlet is provided with a mounting section for mounting the fan case to the housing.

8. The air blowing device of claim 1, wherein the suction port is formed in an underside of the housing, and the blow-off port is formed in a lateral face of the housing.

9. The air blowing device of claim 8, wherein the housing has a box shape.

10. The air blowing device of claim 1, wherein a plan area of the impeller falls within a range from not smaller than ⅛ to not greater than ⅓ of a plan area of the housing.

11. The air blowing device of claim 1, wherein a plan area of the impeller falls within a range from not smaller than ⅛ to not greater than ¼ of a plan area of the housing.

12. The air blowing device of claim 1, wherein the impeller is centered at a region farthest from the outlet, the region is one of four regions equally divided both laterally and longitudinally across a plan area of the housing.

13. The air blowing device of claim 1, wherein a distance from the tongue section to the outlet is 5 times or more of a radius of the tongue section.

14. The air blowing device of claim 1, wherein the fan case is curved to protrude toward the inlet where the impeller exists.

* * * * *